US006390805B1

(12) United States Patent
Paschereit et al.

(10) Patent No.: US 6,390,805 B1
(45) Date of Patent: May 21, 2002

(54) METHOD OF PREVENTING FLOW INSTABILITIES IN A BURNER

(75) Inventors: Christian Oliver Paschereit, Baden; Jakob Keller, deceased, late of Wohlen, both of (CH), by Maria Keller-Scharli, Vera Keller and Georg Keller, legal representives

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/382,628

(22) Filed: Aug. 25, 1999

(30) Foreign Application Priority Data

Sep. 16, 1998 (EP) ..... 98810924

(51) Int. Cl.[7] ..... F23M 3/04

(52) U.S. Cl. ..... 431/10; 431/114; 431/350; 431/354

(58) Field of Search ..... 431/4, 8, 9, 2, 431/351, 350, 353, 354, 114, 173, 115

(56) References Cited

U.S. PATENT DOCUMENTS

| | | | | |
|---|---|---|---|---|
| 3,788,065 A | * | 1/1974 | Markowski | 431/173 |
| 3,879,939 A | | 4/1975 | Markowski | |
| 5,345,768 A | | 9/1994 | Washam et al. | |
| 5,758,587 A | | 6/1998 | Büchner et al. | |

FOREIGN PATENT DOCUMENTS

| | | | | |
|---|---|---|---|---|
| EP | 0 321 809 | | 5/1991 | |
| EP | 0 433 790 | | 6/1991 | |
| GB | 1134996 | | 11/1968 | |
| JP | 108507 | * | 7/1982 | 431/114 |
| JP | 108508 | * | 7/1982 | 431/114 |
| JP | 56032961 | | 9/1982 | |
| JP | 56032962 | | 9/1982 | |

* cited by examiner

*Primary Examiner*—James C. Yeung
(74) *Attorney, Agent, or Firm*—Burns, Doane, Swecker & Mathis, L.L.P.

(57) ABSTRACT

In a method of, and an appliance for, operating a burner (26), in which a combustion air flow (14) transports fuel into a combustion chamber (28) where the fuel is burnt, the formation of coherent flow instabilities of the combustion air flow (15) after emergence into the combustion chamber (28) is prevented by perturbation air (22) being injected into the combustion air flow (15).

18 Claims, 4 Drawing Sheets

METHOD OF PREVENTING FLOW INSTABILITIES IN A BURNER

BACKGROUND OF THE INVENTION

1. Field of the Invention

The present invention pertains to the field of burners, particularly burners for use in gas turbines. It relates to an appliance for, and a method of, operating a burner, in which a combustion air flow transports fuel into a combustion chamber where the fuel is burnt.

2. Discussion of Background

In modern burners, particularly in burners such as are used in gas turbines, it is becoming increasingly important to keep the combustion both as efficient as possible and as free from pollutants as possible. Pollutant limits are specified by the authorities, inter alia, and the regulations with respect to CO and $NO_x$ emission are becoming increasingly strict. The corresponding optimization of the combustion can take place in a variety of ways, for example by the admixture of additives such as water to the fuel, by the employment of catalyzers or also by ensuring ideal fuel/air mixtures for the combustion. Optimum fuel/air ratios can be achieved by premixing fuel and combustion air (so-called premixing burners) or by injecting fuel and combustion air together in a special manner into the combustion space.

EP-B1-0 321 809 reveals a burner for liquid and gaseous fuels, without premixing section, in which combustion air supplied externally enters through at least two inlet slots tangentially between hollow half-cones in an offset arrangement and, in this location, flows in the direction of the combustion chamber, and in which the liquid fuel is injected centrally on the tapered side, facing away from the combustion chamber, of the half-cones. The fuel is therefore entrained and "enveloped", so to speak, by the combustion air, so that a conical liquid fuel profile forms between the half-cones, spreads out in the direction of the combustion chamber and burns there. Gaseous fuel is injected transversely into the entering air, through rows of holes, from fuel supply pipes which extend along the air inlet slots.

A problematic feature of such burners, and generally in the case of burners in which a flow of combustion air flows in a similar manner into a combustion chamber, is the emergence of the combustion air in the combustion chamber. Whereas the combustion air in the burner slides along the walls of the half-cones and is guided by them, a shear layer forms immediately behind the front edge of the half-cones, in the flow direction of the combustion air. This shear layer is located between the substantially stationary and hot combustion gases located in the combustion chamber and the emerging, flowing mixture of fuel and combustion air. Now, it is in the nature of such shear layers that they roll up at some point and result in vortices. They roll up in such a way that so-called Kelvin-Helmholtz waves, whose wave crests extend transversely to the flow direction, form first on the shear layers and then generate vortices.

It is found that it is these instabilities on shear layers, in combination with the combustion process taking place, which are mainly responsible for an important class of thermoacoustic oscillations initiated by reaction rate fluctuations. These substantially coherent waves lead, in the case of a burner of the type mentioned above and at typical operating conditions, to vibrations with frequencies of approximately 100 Hz. Since this frequency coincides with typical fundamental natural modes of many gas turbine annular burners, the thermoacoustic oscillations present a problem.

SUMMARY OF THE INVENTION

Accordingly, one object of the invention is to provide a novel appliance or burner and a method which prevents the formation of coherent flow instabilities of the combustion air flow after emergence into the combustion chamber.

This object is achieved in an apparatus and a method of the type described at the beginning by perturbation air being injected into the combustion air flow. The core of the invention therefore consists in the fact that the injected perturbation air already prevents the excitation of thermoacoustic oscillations in a specific manner at the cause of their formation.

A first preferred embodiment of the invention is one wherein the coherent flow instabilities, after emergence of the combustion air into the combustion chamber, form as a consequence of shear layers between the combustion air flow and substantially stationary hot gases in the combustion chamber, and wherein the perturbation air acts on these shear layers. The perturbation air is then preferably injected into the combustion air flow substantially at right angles to a main flow direction of the combustion air flow and substantially parallel to the shear layers, preferably even into the shear layers. By this means, the formation of Kelvin-Helmholtz waves in the flow direction is specifically nipped in the bud.

Another embodiment of the invention is one wherein the burner is a double-cone burner, wherein the injection of the perturbation air takes place through perturbation nozzles, and wherein the perturbation air occurs directly at the front edges of the half-cones, where the shear layers form. If, furthermore, the perturbation nozzles are preferably distributed uniformly at certain distances apart around the peripheries of the front edges of the half-cones, this perturbs the periodicity of the waves on the shear layers and specifically prevents the thermoacoustic oscillations at the outset of their formation.

Further embodiments of the method and of the apparatus follow from the dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The principle of operation of the approach described shall first be rationalized and explained on the basis of some theoretical considerations; the technical embodiment examples are then described.

Figure 1:
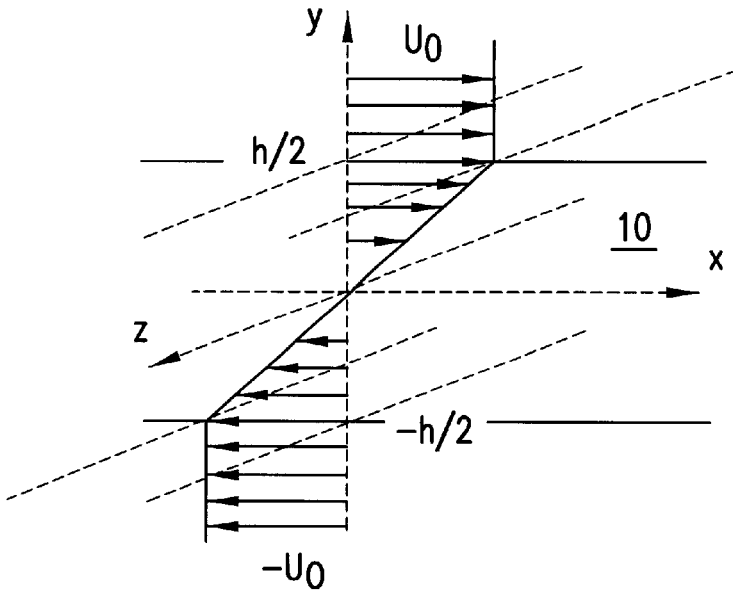
FIG. 1 shows a diagrammatic representation of a shear layer and the parameters, including coordinate system, used in the description.

Referring now to the drawings, wherein like reference numerals designate identical or corresponding parts throughout the several views, FIG. 1 shows a section through an idealized shear layer 10, such as is assumed in the following calculations. The shear layer 10 has a thickness h and the coordinate system is laid out in such a way that the axes x and z are located in the shear layer and the axis y is at right angles to them and in such a way that the main flow direction (longitudinal) extends along x. In order to simplify the calculations, the origin of the coordinate system is located in such a way that the thickness of the shear layers 10 extends along y from −h/2 to +h/2 and that the layer located at the top in the figure moves to the right along x with a velocity $U_0$ whereas the layer represented at the bottom in FIG. 1 moves to the left along x with a velocity $-U_0$. Transferred to the situation (upon emergence) from a burner 26, this means that the upper layer represents the emerging combustion air 15 with a velocity 2 $U_0$ to the right along x and that the lower layer represents the idealized stationary air in the combustion chamber. A linear velocity profile along y is assumed in the shear layer 10, this exhibiting the following mathematical form:

$$u=u_0(y)=H(y-h/2)U_0+H(y+h/2)H(-y+h/2)2yU_0/h-H(-y-h/2)U_0$$

$$v=0,\ w=0$$

where H is the following Heaviside function $$H(y)=\begin{cases}1, & \text{if } y>0\\ 0.5, & \text{if } y=0\\ 0, & \text{if } y<0\end{cases}$$

and u, v and w are the velocities along x, y and z.

If varicose perturbations are assumed along the shear layer 10 and if the equations for flow at constant volume (only valid for low Mach numbers) are now used, together with the conservation of mass and angular momentum, the result is a system of equations with the following solution, which is constant at the points y=±h/2:

$$\left(\frac{\alpha h}{U_0}\right)^2=\left[1-\frac{k_z^2h^2}{k^2h^2}\right]\{\exp(-2kh)-[1-kh]^2\}.$$

In this, α is the growth exponent of the perturbation 1/s, $U_0$ is the velocity at the edge of the shear layer 10, k is the wave number along x and z, defined as $k^2=k_x^2+k_z^2$, and $k_z$ is the component of the wave vector along z, i.e. in the transverse direction.

Figure 2:
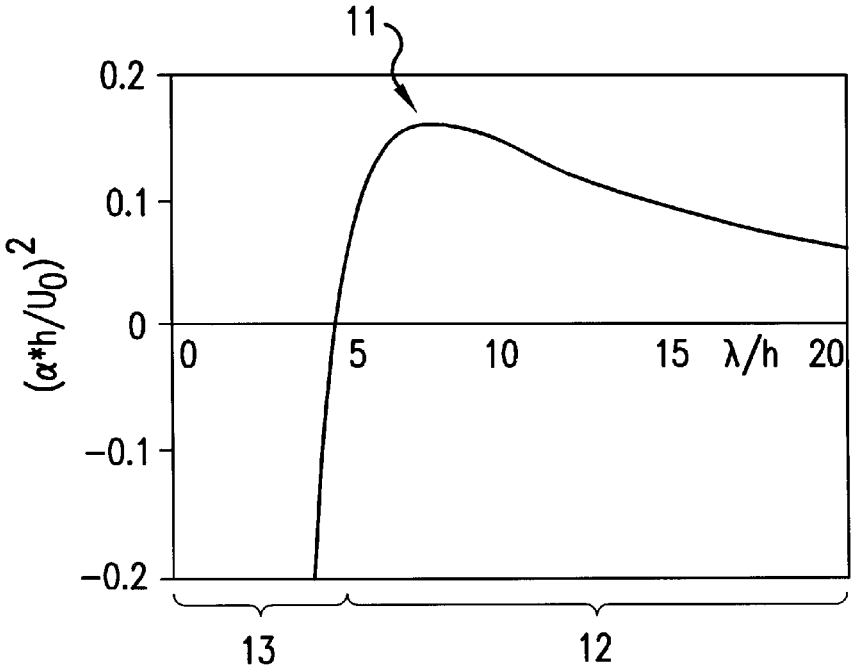
FIG. 2 shows the non-dimensional growth coefficient as a function of the non-dimensional wave length.

For the case where $k_z$ tends to 0, the above solution reduces to the case of the two-dimensional Kelvin-Helmholtz waves. If the non-dimensional growth exponent (left-hand side of the above equation) for the two-dimensional case is plotted as a function of the non-dimensional wave length of the Kelvin-Helmholtz waves, defined as $$\frac{\lambda}{h}=\frac{2\pi}{k_xh}$$

the functional relationship represented in FIG. 2 is obtained. It is interesting to note that, for wave lengths λ<4.91 h (Range 13), the perturbation is stable whereas it grows for λ>4.91 h (Range 12). Maximum growth is obtained for λ=7.89 h (11).

Figure 3:
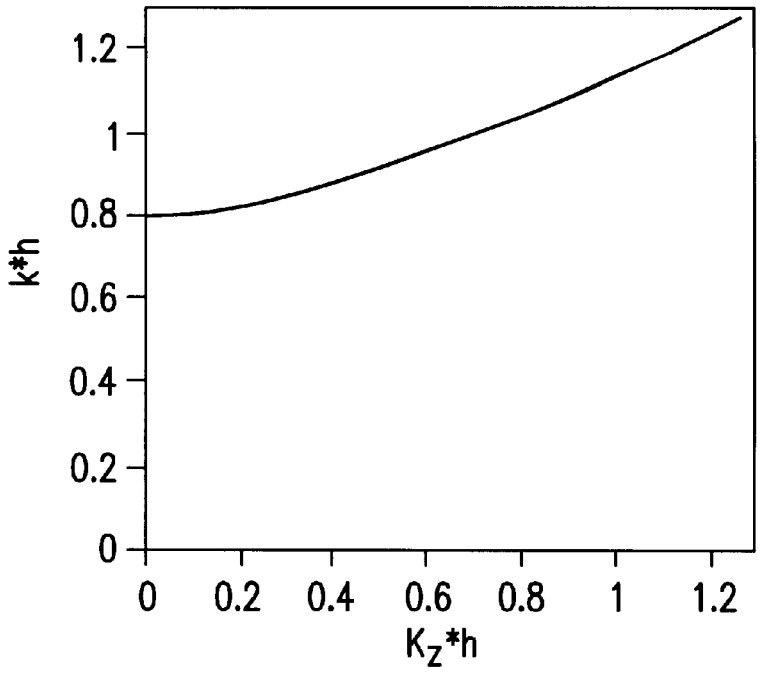
FIG. 3 shows the non-dimensional wave number with maximum growth as a function of the non-dimensional, transverse component of the wave vector.
Figure 4:
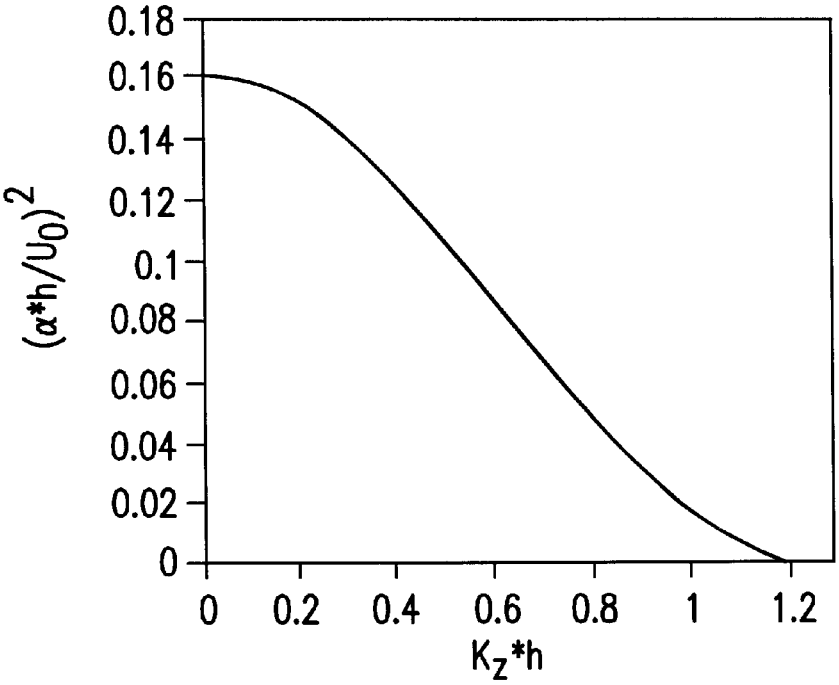
FIG. 4 shows the non-dimensional growth factor as a function of the non-dimensional transverse component of the wave vector.

Now, the noteworthy result of the general, three-dimensional case of the above solution is that the shear layer 10 is stable for all values of the x component of the wave vector $k_x$ (in the flow direction); to this extent, therefore: $|K_zh|>1.278$! In other words, a sufficiently strong transverse waviness with a transverse wave length $\lambda_z$ which satisfies the condition $\lambda_z<4.91$ h can prevent the formation of Kelvin-Helmholtz waves. FIG. 3 correspondingly shows the norm of the wave vector for maximum growth as a function of the non-dimensional transverse component of the wave vector. The associated relationship between the non-dimensional growth coefficient and the non-dimensional transverse component of the wave vector is represented in FIG. 4. As mentioned above, it is found that any growth of the longitudinal waviness is eliminated for $|K_zh|>1.278$.

Now, the idea is to induce a suitable transverse perturbation in the shear layer in order to prevent the Kelvin-Helmholtz waves. In order to calculate the ideal type for this perturbation, it would actually be necessary to calculate the thickness of the shear layer 10 at the location where the wave breaks. It is, however, simpler just to base the calculation on the relationships present in practice and to include the actually occurring frequency of the separation of the vortices, here indicated by f, in the calculation. Since the vortices propagate in the main flow direction x with half the velocity of the main flow, the following relationship can be established:

$$\lambda=\frac{U}{2f}$$

where U is the absolute flow velocity directly adjacent to the shear layer 10. If it is now assumed that the frequency f corresponds to the wave length with maximum growth, this gives the stability condition $$\lambda_z<0.312\frac{U}{f}.$$

If the setting of a preferably low flow velocity of U=20 m/s is assumed for double-cone burners and a conservatively high frequency of f=125 Hz is also assumed, this gives the following distance between the perturbations $$\lambda_z=0.312\frac{20\text{ m/s}}{125\text{ Hz}}\approx 5\text{ cm}.$$

The significance of this in practice is now as follows: If the formation of Kelvin-Helmholtz waves in the flow direction is perturbed, for example by means of injecting perturbation air 22 in the transverse direction, i.e. at right angles to the main flow direction and in the shear layer 10 with a distance apart of the perturbation nozzles 16 of approximately 5 cm in the x direction, there is also no formation of thermoacoustic oscillations of the frequency of 125 Hz assumed above.

FIG. 5 shows various views of a double-cone burner to show the technical realization of the principle described above. FIG. 5*a* shows a perspective view of a double-cone burner. The combustion air 14 enters laterally through the inlet slots 23 of the hollow half-cones 18 and 21 arranged with slightly offset axes, flows to the front end of the burner while describing a slight curve and, after passing the front edges 24 of the half-cones, emerges from the burner 26 into the combustion chamber. At the tapered end of the half-cones 18 and 21, there is a cylindrical part 20 in which a fuel nozzle is arranged which, in this case, injects liquid fuel centrally between the two half-cones 18 and 21. The combustion air flow 14 envelops the injected fuel and a fuel cone is formed which widens in the forward direction and which, after emerging into the combustion chamber 28, burns in the flame 17 at the burner opening 27.

Figure 5A:
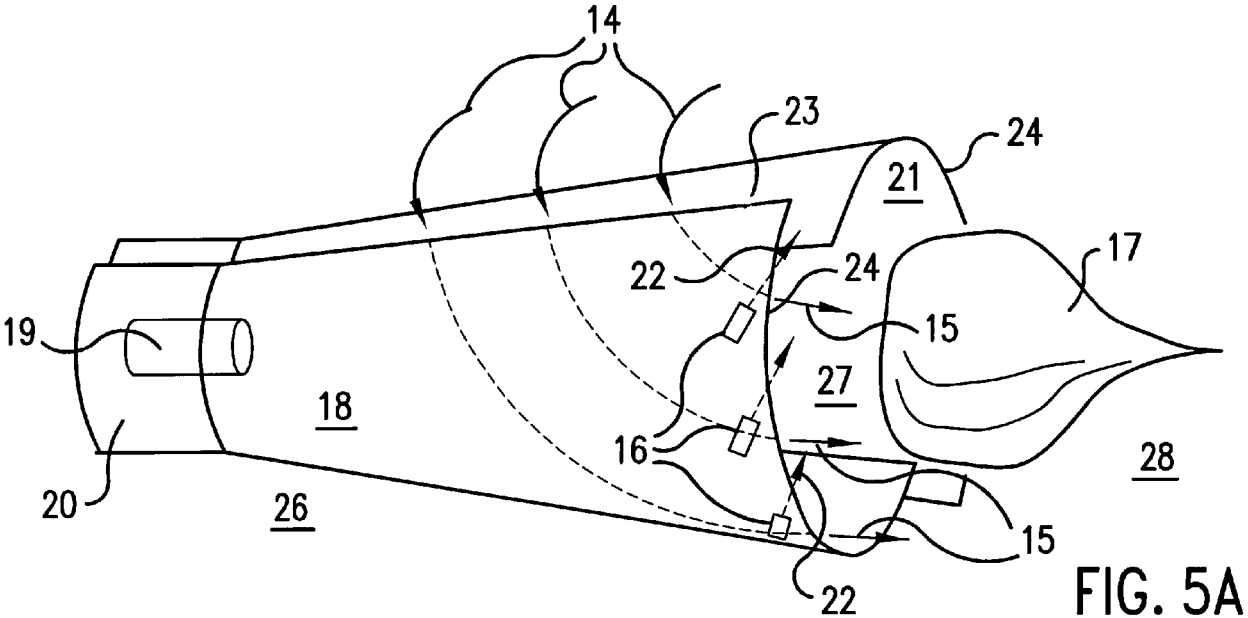
FIG. 5 shows diagrammatic representations of a double-cone burner. a) perspective view, b) section through perturbation nozzle at right angles to the main flow direction, c) view from above, d) view from the front.
Figure 5B:
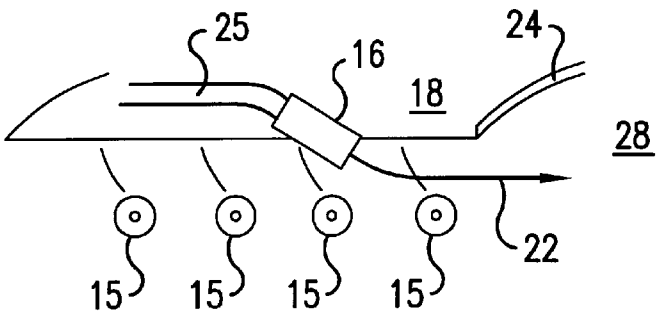

In the half-cones 18 and 21, perturbation nozzles 16 are now arranged at uniform distances directly at the front edges 24. Each of them injects a perturbation air flow 22, at right angles to the combustion air flow direction 15, into the combustion air flow 15. This takes place as indicated in FIG. 5*b*): The perturbation nozzles 16, which are supplied by lines 25, inject the perturbation air 22 at a shallow angle below the half-cones. This directly at the front edges 24, so that the perturbation air 22 flows essentially into the shear layer 10 forming behind the edge, between the combustion air flow 15 and the substantially stationary air in the combustion chamber 28. The injection takes place at right angles to the direction of the combustion air flow 15 (circle with dot in the center stands for an arrow which is directed upward out of the plane of the paper) and therefore generates the perturbation in the shear layer 10 required by the theory.

Figure 5C:
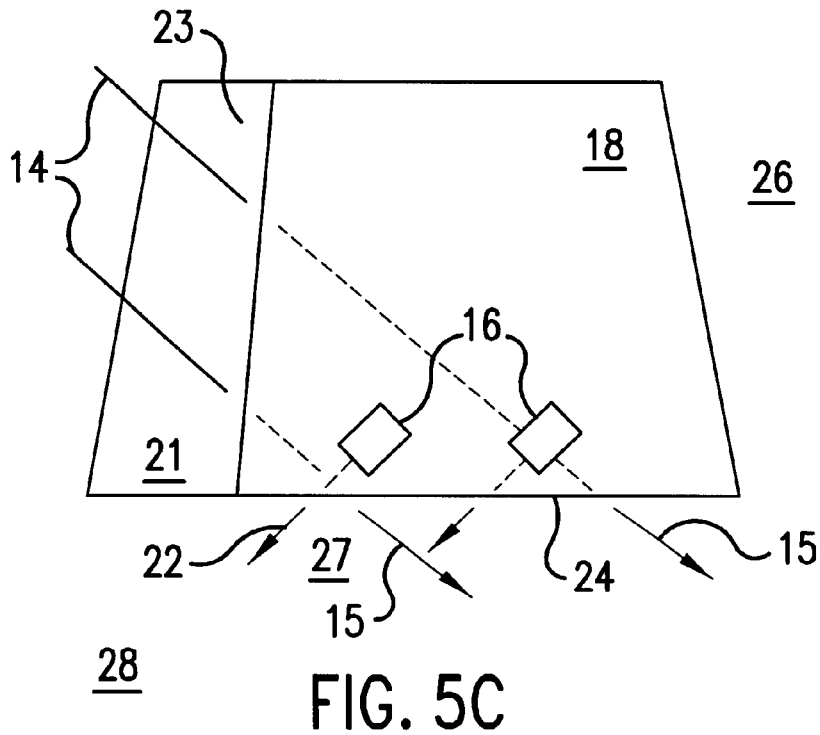
Figure 5D:
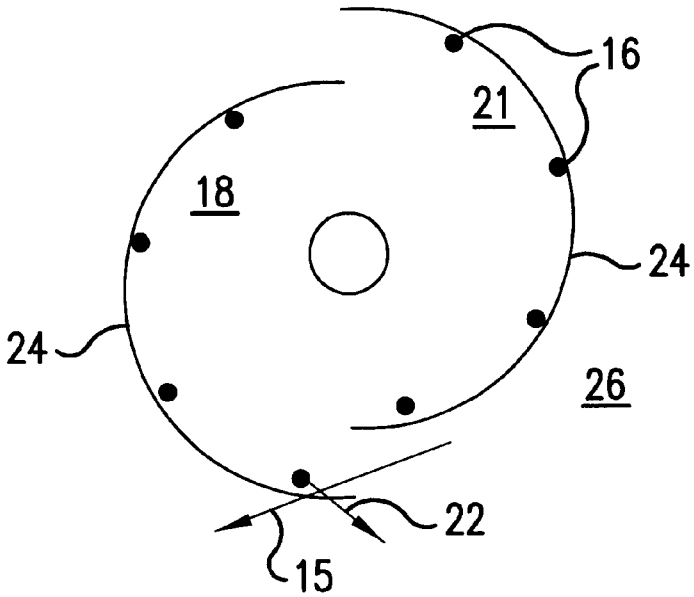

FIG. 5*c*) shows a view from above onto the double-cone burner 26. The distance between the perturbation nozzles 16 can easily be deduced from this view. For the 5 cm given as the wave length $\lambda_z$ in the above numerical example to result, the transverse perturbation must take place in such a way that the perturbation nozzles 16 generate perturbation air flows 22 which are at a distance of 5 cm from one another in the x direction, i.e. in the flow direction of the combustion air flow 15. FIG. 5*d*) shows a diagrammatic front view of a double-cone burner 26. The orthogonally intersecting flow of the two air flows 15 and 22 can be recognized in turn. It is important for the injected air 22 to have no strong inwardly directed components, so that the main air flow 15 is not perturbed. In addition, the total pressure with which the perturbation air 22 is injected must be at least as large as the total pressure of the combustion air 15 flowing past, so that no significant transverse perturbations at all can form.

Obviously, numerous modifications and variations of the present invention are possible in light of the above teachings. It is therefore to be understood that within the scope of the appended claims, the invention may be practiced otherwise than as specifically described herein.

What is claimed is:

1. A method of operating a burner, comprising:

transporting fuel into a combustion chamber by a combustion air flow; and injecting perturbation air, into the combustion air flow and fuel substantially at right angles to a main flow direction of the combustion air flow and substantially parallel to a shear layer, to prevent the formation of coherent flow instabilities in the combustion air flow after emergence into the combustion chamber.

2. The method as claimed in claim 1, wherein the burner is a burner without premixing section.

3. The method as claimed in claim 1, wherein the burner is operated with liquid or gaseous fuel.

4. The method as claimed in claim 1, wherein the flow instabilities occur as a result of Kelvin-Hemholtz waves on the shear layers.

5. The method as claimed in claim 1, wherein the perturbation air is injected essentially into the shear layers between combustion air flow and substantially stationary hot gases in the combustion chamber.

6. The method as claimed in claim 1, wherein the perturbation air is injected into the mixture essentially shortly before the emergence of the combustion-air/fuel mixture into the combustion chamber.

7. The method as claimed in claim 6, wherein the burner is a double-cone burner in which combustion air enters through at least two inlet slots tangentially between hollow half-cones in an offset arrangement and, in this location, flows in the direction of the combustion chamber, wherein the fuel is injected centrally on the tapered side, facing away from the combustion chamber, of the half-cones and/or wherein gaseous fuel is injected transversely into the entering air flow, through rows of holes, from two gas supply pipes which extend along the air inlet slots, wherein the half-cones are bounded by front edges at the combustion chamber end, and wherein injection of perturbation air takes place through perturbation nozzles.

8. The method as claimed in claim 7, wherein the perturbation nozzles are let into the half-cones essentially immediately before the front edges, and wherein the perturbation nozzles inject the perturbation air into the combustion air flow and essentially into the shear layers occurring immediately behind the front edges.

9. The method as claimed in claim 8, wherein there is a plurality of perturbation nozzles, and wherein the perturbation nozzles inject the perturbation air so that it is uniformly distributed around the peripheries of the half-cones.

10. The method as claimed in claim 9, wherein the distance apart of the perturbation nozzles uniformly distributed around the half-cones generates perturbations which prevent a growth of the coherent flow instabilities in the combustion air flow because a non-dimensional component of the wave vector is generated at right angles to the main flow direction of the combustion air, which has a magnitude greater than a critical valve.

11. The method as claimed in claim 10, wherein the critical valve is 1.278, and wherein the distance apart of the perturbation nozzles is correspondingly selected as a function of a frequency of the coherent flow instabilities of the combustion air flow which occurs without perturbation nozzles.

12. The method as claimed in claim 11, wherein the total pressure with which the perturbation air is injected is at least as large at the total pressure of the combustion air flowing past.

13. A burner, comprising:

a double-cone burner in which combustion air enters through at least two inlet slots located between two half cones in an offset arrangement;

fuel is transported by the combustion air which flows in the direction of a combustion chamber;

the half-cones are bounded by front edges at the combustion chamber end; and perturbation nozzles which inject perturbation air into the half-cones immediately before the front edge of the half-cones, such that the perturbation air is injected at right angles in the flow direction of the combustion air from the outside of the half-cones into the combustion air flowing to the combustion chamber.

14. The burner as claimed in claim 13, wherein the perturbation nozzles are arranged in the half-cones in such a way that they inject the perturbation air essentially into the shear layers occurring behind the front edge.

15. The burner as claimed in claim 14, wherein there is a plurality of perturbation nozzles, and wherein the perturbation nozzles are uniformly distributed around the peripheries of the half-cones.

16. The burner as claimed in claim 15, wherein the uniform distance apart of the perturbation nozzles is selected in such a way that it is equal to or smaller than a critical value, and wherein the critical value is derived from the flow velocity of the combustion air and the frequency of the coherent flow instabilities which occurs in the combustion air flow of the burner without perturbation nozzles.

17. The burner as claimed in claim 16, wherein the critical value is given by multiplying by 0.312 the quotient of the flow velocity of the combustion air and the frequency of the coherent flow instabilities of the combustion air flow which occurs in the burner without perturbation nozzles.

18. The burner as claimed in claim 16, wherein, in the case of a frequency of the coherent flow instabilities of the combustion air flow which occurs in the burner without perturbation nozzles in the range from 100 to 125 Hz and in the case of a flow velocity of the combustion air in the range from 20 to 30 m/s, the perturbation nozzles on the half-cones have a distance apart in the range from 3 to 5 cm, in particular in the range from 4.5 to 5 cm.

* * * * *